United States Patent [19]

Mulcahy

[11] 4,385,679

[45] May 31, 1983

[54] DESCENT CONTROL DEVICE

[76] Inventor: Timothy E. Mulcahy, 8900 Lori La., Orland Park, Ill. 60462

[21] Appl. No.: 234,885

[22] Filed: Feb. 17, 1981

[51] Int. Cl.[3] ..... A62B 1/14

[52] U.S. Cl. ..... 182/5; 188/65.2

[58] Field of Search ..... 182/5, 6, 7; 188/65.1, 188/65.2

[56] References Cited

U.S. PATENT DOCUMENTS

| | | | |
|---|---|---|---|
| 465,464 | 12/1891 | Dixon | 182/5 |
| 482,813 | 9/1892 | Schwarz | 182/6 |
| 1,766,566 | 6/1930 | Tucker | 182/7 |
| 3,179,994 | 4/1965 | Meyer | 182/3 |
| 3,335,469 | 8/1967 | Shand et al. | 182/5 |
| 3,389,765 | 6/1968 | Pressley | 182/5 |
| 3,861,497 | 1/1975 | Tsai | 182/5 |
| 3,889,777 | 6/1975 | George | 182/6 |
| 3,927,734 | 12/1975 | Brunette et al. | 182/6 |

*Primary Examiner*—Reinaldo P. Machado
*Attorney, Agent, or Firm*—Keil & Witherspoon

[57] ABSTRACT

There is claimed a descent control device which comprises a rope along which a person desires to descend from an elevated position; a housing substantially cylindrical in shape; attachment means to attach the person to the housing; a guide means mounted axially within the housing and providing an open channel between the two ends of the housing, and having the rope passing through the open channel thereby slidably attaching the housing to the rope; a crank which has a knuckle formed into a rotating shaft so that rotation of the crank urges the knuckle against the rope, thereby providing friction between the rope and the housing so as to provide a safe descent along the rope for the person; and a spring which urges the knuckle against the rope so as to make use of the device safe for an incapacitated person.

6 Claims, 5 Drawing Figures

DESCENT CONTROL DEVICE

BACKGROUND OF THE INVENTION

This invention relates generally to devices for safely descending a rope. This invention is particularly adaptable to assisting a person to escape from a burning building by safely descending a rope. The device is simple in operation, provides safety in case the person is incapacitated and cannot operate the device, and allows several different persons to descend the same rope simultaneously.

The devices taught by the prior art for safely descending a rope are cumbersome, unsafe for an incapacitated person, or do not permit several persons to descend along a rope at one time.

Use of the present invention is superior to devices of the prior art and also to mountain climbing rapelling techniques. In none of the prior art can both an unconcious person descend safely and several persons descend simultaneously along the same rope. The present invention is safe for an unconscious person because it incorporates a spring which applies pressure to the rope at all times. Several persons can descend simultaneously along one rope because the rope goes straight through the device. Devices of the prior art put bends, twists, or kinks in the rope, and mountain rapelling techniques require that the rope loop around the person descending. If a person's descent puts loops, twists, kinks, or bends in the rope, then a weight below the person interferes with his descent. The present invention puts no loop, twist, bend, or kink in the rope, and so a weight on the rope below a person will not interfere with his descent.

U.S. Pat. No. 3,927,734 discloses an emergency descent device which allows a person to control his descent along a rope. The rate of descent of the person is controlled by friction wherein the rope is pinched between the body of the device and a movable lever. However, the device has an open seat which makes it dangerous for an unconscious or otherwise incapacitated person. Also the rope has a bent path which precludes the descent of several persons simultaneously along one rope.

U.S. Pat. No. 3,889,777 discloses a device to be strapped on a person for controlling descent down a cable or rope. However, the device has a complex set of intermeshing teeth which bend the path of the rope. A weight hanging from the rope below the operator would make the device difficult to operate. In contrast, in the present invention, the application of friction to the rope is mechanically simple, and the path of the rope is not bent by application of friction, thereby avoiding both disadvantages of the prior art.

SUMMARY OF THE INVENTION

The invention is a descent control device comprising:

a rope with a first end attached at an elevated position from which a person desires to descend, and a second end located at a lower point to which said person desires to descend;

a housing substantially cylindrical in shape;

a guide means mounted axially within said housing and providing an open channel between the two ends of said housing, and having said rope passing through said open channel thereby slidably attaching said housing to said rope;

a crank with a first bend which divides said crank into a first part and a second part, said first part rotatably mounted substantially parallel to a diameter of said housing by passing through opposing holes cut in said housing, said first part having a second bend which provides an offset in said first part such that said offset passes through an arc as said crank is rotated, said second part exterior to said housing thereby providing a handle by which said crank may be rotated, and said offset in said first part of said crank having two positions, a first position where said offset slidably contacts said rope thereby pressing said rope against said guide means and thereby producing friction between said rope and said crank and guide means, said friction resisting the descent of said housing along said rope, and a second position wherein said offset does not press against said rope thereby releasing said housing to descend along said rope;

attachment means whereby said person may be attached to said housing thereby providing said person with means to safely descend said rope by his rotating said crank to produce friction between said rope and said guide means and said crank, thereby controlling his descent along said rope.

DETAILED DESCRIPTION OF THE PREFERRED EMBODIMENTS

Since the primary use of the descent control device which I have invented is to escape from burning buildings in the event of fire in the building, this detailed description refers to that use. However, the principles of this invention are applicable to many other uses, three examples of which are descent from a mountain, descent from the mast of a ship, or descent from a helicopter. Persons of ordinary skill in this art may perform such adaptations by reading this specification.

Figure 1:
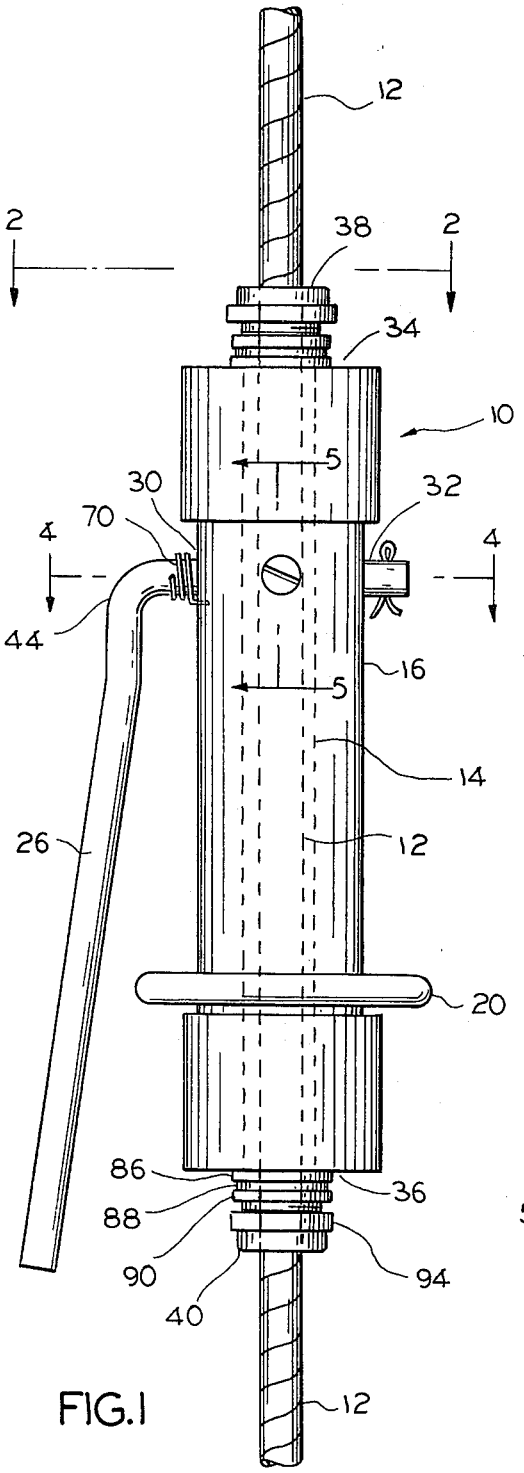
FIG. 1 is a front view of the descent control device.
Figure 2:
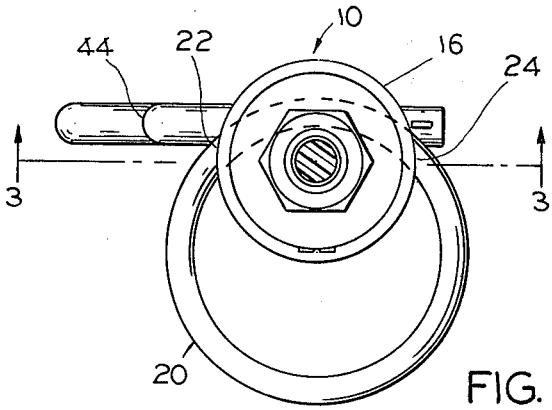
FIG. 2 is a top view of the descent control device viewed along plane 2 as indicated in FIG. 1.

Referring first to FIG. 1, a front view of the descent control device 10 is shown. A rope 12 is attached to an elevated position (not shown) from which a person (not shown) wishes to descend. The rope 12 passes through an open channel 14 within the housing 16. Dashed lines are used to indicate rope 12 and open channel 14 where they are within housing 16. A ring 20 passes through holes 22 and 24 made in housing 16, as shown in FIG. 2. A person (not shown) is attached to ring 20 by passing a belt (not shown) through ring 20. Referring again to FIG. 1, a crank 26 is rotatably mounted through holes 30 and 32 in housing 16. In the detailed embodiment described herein, open channel 14 is affixed to the ends 34 and 36 of housing 16 by means of nuts 38 and 40. Rope 12 may be made of any convenient material, ½ inch nylon has been found to be suitable. The use of ¾ inch or larger nylon rope would make it possible for several persons to simultaneously descend safely, and to descend from very high locations. Also a wire backed rope or a metal cable could be employed for rope 12, and all such alternative embodiments are referred to as "rope".

Referring to FIG. 2, a top view of the descent control device 10 is shown. The ring 20 used for attachment of a person (not shown) to the descent control device 10 is shown penetrating housing 16 through holes 22 and 24. Crank 26 also is shown in top view, and bend 44 is indicated.

Figure 3:
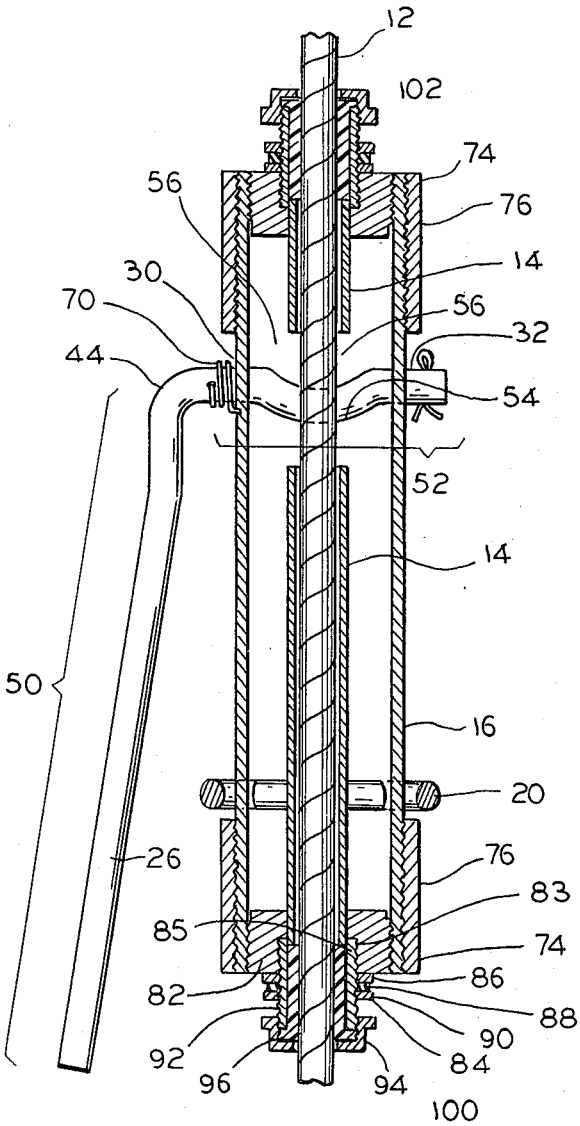
FIG. 3 is a cutaway front view as seen along plane 3 as indicated in FIG. 2.
Figure 4:
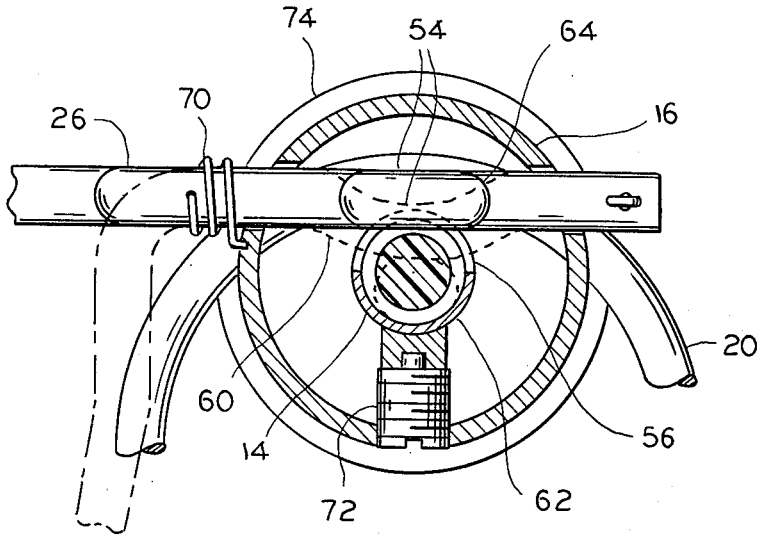
FIG. 4 is a cutaway top view as seen along plane 4 as indicated in FIG. 1.

Referring to FIG. 3, a cutaway front view as seen along plane 3 as indicated in FIG. 2 is shown. Rope 12 is shown passing through open channel 14, within housing 16. Crank 26 is shown penetrating holes 30 and 32. Bend 44 divides crank 26 into two major divisions, the first division 50 which serves as a handle and the second division 52 which is rotatably mounted in holes 30 and 32. Division 52 of crank 26 is bent into a knuckle 54 which lies in the plane defined by division 50 and division 52 of crank 26. Crank 26 is continuously rotatable by means of handle 50 through an arc of approximately 90 degrees. Open channel 14 has a cutout 56 into which knuckle 54 may rotate. At one end of rotatable motion of crank 26, the knuckle 54 has a first position wherein knuckle 54 enters cutout 56 and is slidably urged against rope 12. Contact between knuckle 54 and rope 12 is more clearly illustrated in FIGS. 4 and 5. FIG. 4 shows that cutout 56 in open channel 14 penetrates only about halfway through open channel 14. When knuckle 54 is rotated into its first position 60, knuckle 54 enters cutout 56 and urges rope 12 against the remaining material 62 behind cutout 56 of open channel 14, thereby producing friction between rope 12 and open channel 14. The friction resists the descent of descent control device 10 and the person attached thereto under the influence of gravity. When crank 26 is rotated to the opposite end of its rotary motion, knuckle 54 enters a second position 64 wherein contact between rope 12 and knuckle 54 is lost, thereby permitting free descent along rope 12.

Spring 70 is illustrated in FIGS. 1, 3 and 4. Spring 70 is attached fixedly into crank 26 and is also attached fixedly into housing 16. Spring 70 urges crank 26 to rotate into its first position 60, thereby applying force between knuckle 54, rope 12, and open channel 14 by pressing rope 12 against remaining material 62. Spring 60 provides a safety feature in that it permits a person who is unconscious or otherwise incapacitated to use the present invention without falling freely along rope 12. Spring 70 provides sufficient friction to rope 12 that free fall of an unconscious person is prevented, and the unconscious person has a safe descent along rope 12.

In operation the person or persons descending along rope 12 hang from ring 20 and operate crank 26 by grasping handle 52. By urging knuckle 54 against rope 12 he reduces his descent velocity, and by urging knuckle 54 away from rope 12 he increases his descent velocity. In descending along a rope by operating the device a person may come upon an unconscious person on another device which is stalled because of the dead man's lock. The two devices may then abut each other along the rope. The conscious person (the one above) may reach down and safely operate both devices, because of the small size of the devices and the simplicity of operation of the devices.

Further features of the invention are illustrated in FIG. 4. Brace 72 provides support between housing 16 and remaining material 62 of open channel 14. The force applied by knuckle 54 to rope 12 is transmitted to remaining material 62, and through brace 72 to housing 16. It is desirable to have brace 72 in place because the large mechanical advantage given by the long lever arm of handle 50 and the short lever arm of knuckle 54 can cause bending of open channel 14. With brace 72 in place open channel 14 will not resist all of the force, but will transmit the major part to housing 16, which is very desirable because housing 16 is normally of heavier construction than open channel 14. The outer surface 74 of end caps 76 of housing 16 is also illustrated in FIG. 4.

Figure 5:
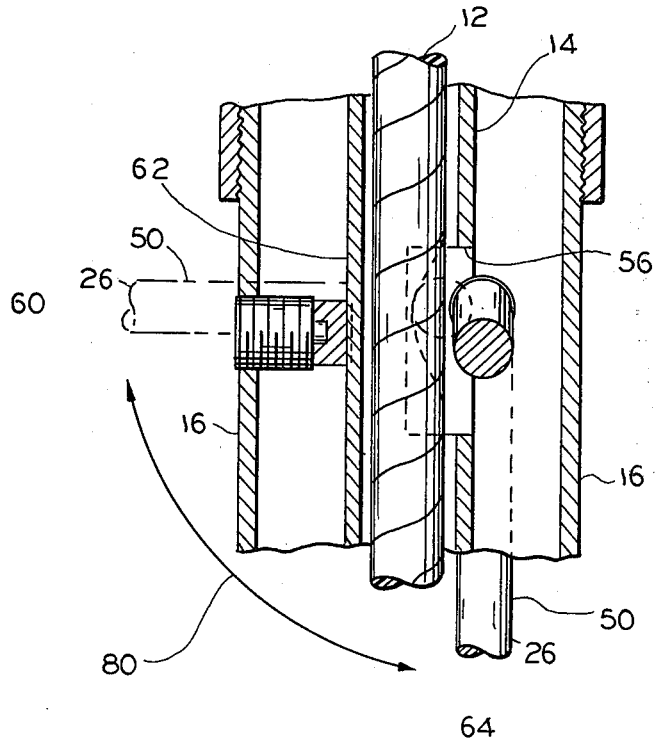
FIG. 5 is a cutaway side view as seen along plane 5 as indicated in FIG. 1.

Turning to FIG. 5, the two positions of crank 26 are illustrated. In position 60 handle 50 of crank 26 stands at approximately right angles to rope 12, and knuckle 54 is urged against rope 12. The force applied by knuckle 54 to rope 12 is urged against remaining material 62 of cutout 56 and is transmitted by brace 72 to housing 16. The second position 64 of crank 26 is illustrated, wherein knuckle 64 loses contact with rope 12. The range of rotatory motion of handle 50 is illustrated by arrow 80.

A safety feature of the descent control device 10 is the design of the mounting and angle of knuckle 54 such that descent along rope 12 causes friction between knuckle 54 and rope 12, and that friction causes knuckle 54 to rotate into rope 12. Rotation of knuckle 54 into rope 12 increases the friction between knuckle 54 and rope 12, and the friction may be great enough to stop the descent along rope 12. Thus descent of the device 10 along rope 12 causes knuckle 54 to rotate into rope 12, thereby stopping descent along rope 12. Descent may only be accomplished by the operator actively rotating crank 26 so that knuckle 54 is urged away from rope 12. The necessity of active operator intervention in order to accomplish descent along rope 12 is called a "dead man's lock". The "dead man's lock" makes it safe for a person who is descending to become unconscious. The unconscious person then becomes stuck along rope 12 when his device 10 locks onto rope 12. The unconscious person may then be rescued by another person descending from above him, and the upper person operating both descent control devices. The operation of the devices 10 is sufficiently simple so that one person can operate two of them in a rescue operation.

A person (not shown) may be attached to the descent control device 10 by a belt (not shown) passed through ring 20. Several persons may be attached to one descent control device 10 by belts passing through ring 20. Or alternatively slots or holes (not shown) may be cut in the housing 16 and belts or ropes passed therethrough for the purpose of attaching one or more persons to the device 10. One of the persons attached to device 10 may be unconscious for a rescue operation.

An example of an embodiment found to perform satisfactorily, along with important dimensions and materials is given herewith. The housing 16 is made of aluminum pipe of length approximately 8 inches, outer diameter of approximately $2\frac{1}{2}$ inches, wall thickness approximately $\frac{1}{8}$ inch, and threaded on the outside on each end. End caps 76 are made of aluminum pipe fittings, threaded on the inside so as to mate with the outside threads cut into housing 16, and of length approximately 2 inches and wall thickness of approximately 3/16 inch. End plug 82 is a pipe reduction fitting with exterior threads to mate with end cap 76, with a length of approximately $\frac{7}{8}$ inches and with an outer diameter of approximately $2\frac{1}{4}$ inches, and an inner hole 83 of approximately 1 inch diameter is axially provided, and the hole 83 is internally threaded. Nipple 84 is a steel or aluminum pipe of length approximately $1\frac{1}{8}$ inches and 1 inch outer diameter at a first end 85 with external threads which mate with the internal threads of the hole 83 in end plug 82. Nut 86 presses washer 88 against surface 90 of nipple 84. First end 85 of nipple 84 screws into hole 83, and the depth which hole 83 is penetrated can be controlled by varying the number and thickness of washer 88. A penetration depth of approximately ¼ inch of the first end 85 of nipple 84 into hole 83 has been found to be satisfactory.

Nipple 84 has a second end 92 of diameter approximately 1⅛ inch with exterior threads and length of approximately ½ inch measured from surface 90. A nut 94 fits over the end 96 of nipple 84. Nut 94 holds a plastic liner (not shown) in place within nipple 84. The plastic liner (not shown) prevents abrasion of rope 12 as it passes through the central hole in nipple 84. Both end 100 and end 102 are similarly constructed. Open channel 14 is made of steel or aluminum tubing approximately 9¾ inches long with outer diameter of approximately ¾ inch and wall thickness of approximately 1/16 inch, leaving an inner diameter of approximately ⅝ inches. Open channel 14 is fixedly attached to end plug 82 located at end 100 of housing 16.

Crank 26 is made of solid steel rod of ½ inch diameter, handle 50 is approximately 9½ inches long measured from bend 44, and division 52 is approximately 4½ inches long, measured from bend 44. The offset of knuckle 54 is approximately ½ inch from the center line of rotation to center line of the knuckle, giving a total distance of ¾ inch (½ inch offset+½ of the ½ inch rod diameter) from the center line of rotation to the surface which contacts rope 12. The mechanical advantage is the quotient obtained by dividing the handle 50 length by the knuckle 54 offset, which yields (9.5/0.75=)12.6. Holes 30 and 32 are approximately 1¾ inches from end 102 and approximately 6¼ inches from end 100 of housing 16. The open channel 14 is fixedly attached to the end plug at end 100, as by threading or force fitting. The open channel 14 is slidably inserted into hole 83 of the end cap at end 102. The cutaway 56 in open channel 14 is approximately 1½ inches long and begins at a distance of approximately 2¼ inches from end 102 and extends to a distance of approximately 3¾ inches from end 102. Cutout 56 is formed by cutting approximately ½ way through the tube forming open channel 14. The length of housing 16 and the length of open channel 14 are such that cutout 56 can be positioned adjacent to knuckle 54 by adjusting the position of the threads of end plug 82 at end 100 where open channel 14 is fixedly attached to end plug 82. The threads at end 102 of housing 16 allow end plug 82 to be screwed so that first end 85 of nipple 84 fits snugly against end 102 of open channel 14, thereby firmly holding open channel 14 in place. Brace 72 is made of metal and is fixedly held in place so as to provide support for open channel 14 when force is applied thereupon by crank 26 through its knuckles 54.

The foregoing description of the invention has been directed to a preferred embodiment in accordance with the requirements of the Patent Act, for the purpose of explaining the invention and not for the purpose of limiting the scope and spirit of what has been disclosed herein. It will be apparent to persons skilled in the art that modifications may be made in the device disclosed herein to suit the device to different materials. The claims appended hereto are intended to set forth the true scope and spirit of the invention, including but not being limited to the particular embodiments disclosed hereinabove.

I claim:

1. A descent control device comprising:

(a) a rope with a first end attached at an elevated position from which a person or plurality of persons desire to descend, and a second end located at a lower point to which said person desires to descend;

(b) a housing substantially cylindrical in shape;

(c) a guide means mounted axially within said housing and providing an open channel between the two ends of said housing, and having said rope passing through said open channel thereby slidably attaching said housing to said rope;

(d) a crank with a first bend which divides said crank into a first part and a second part, said first part rotatably mounted substantially parallel to a diameter of said housing by passing through opposing holes but in said housing, said first part having a second bend which provides an offset in said first part such that said offset passes through an arc as said crank is rotated, said second part exterior to said housing thereby providing a handle by which said crank may be rotated, and said offset in said first part of said crank having two positions, a first position where said offset slidably contacts said rope thereby pressing said rope against said guide means and thereby producing friction between said rope and said crank and guide means, said friction resisting the descent of said housing along said rope, and a second position wherein said offset does not press against said rope thereby releasing said housing to descend along said rope;

(e) attachment means whereby said person may be attached to said housing thereby providing said person with means to safely descend said rope by his rotating said crank to produce friction between said rope and said guide means and said crank, thereby controlling his descent along said rope.

2. A descent control device comprising:

(a) a descent control device as described in claim 1; and (b) a spring, whereby said crank is rotated by said spring into said first position, wherein said offset is rotated against said rope for the purpose of creating said friction between said rope and said crank and said guide means for the purpose of resisting the descent of said housing and said person who is attached to said housing along said rope, thereby an unconscious or otherwise incapacitated person will have his descent along said rope controlled as a safety factor in the use of said descent control device.

3. A descent control device as described in claim 1, wherein said guide means is a cylindrical tube, the interior of which provides said open channel, with a slot cut essential parallel to a diameter of the tube, for the purpose of accepting said offset of said crank into the slot and thereby the opposite side of the tube providing a support surface against which said offset presses said rope.

4. A descent control device as claimed in claim 1, wherein said attachment means comprises an opening through said housing, the opening being formed by two cutouts essentially at opposite ends of a diameter of said housing, whereby said person's or plurality of persons' belts may be passed through said opening for the purpose of attaching his body to said descent control device.

5. A descent control device as claimed in claim 1 wherein said attachment means comprises a ring attached to said housing by passing through two holes which are cut through the wall of said housing, whereby said person's or plurality of persons' body or bodies may be attached to the ring.

6. A descent control device as described in claim 1, wherein said crank is mounted so that motion along said rope of said descent control device causes said offset to rotate into said rope, thereby increasing friction between said rope and said offset so that sufficient friction is developed to halt the descent of said descent control device and any load attached thereto.

* * * * *